US008734304B2

(12) United States Patent
Webber et al.

(10) Patent No.: US 8,734,304 B2
(45) Date of Patent: May 27, 2014

(54) LOW BACK EXERCISE MACHINE WITH ROCKING USER SUPPORT

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., Poway, CA (US)

( * ) Notice: Subject to any disclaimer, the term of this patent is extended or adjusted under 35 U.S.C. 154(b) by 205 days.

(21) Appl. No.: 13/039,830

(22) Filed: Mar. 3, 2011

(65) Prior Publication Data

US 2011/0224052 A1 Sep. 15, 2011

Related U.S. Application Data

(60) Provisional application No. 61/310,585, filed on Mar. 4, 2010.

(51) Int. Cl.
*A63B 21/06* (2006.01)
*A63B 26/00* (2006.01)

(52) U.S. Cl.
USPC ..... 482/94; 482/140

(58) Field of Classification Search
USPC ..... 482/94, 96, 100, 110, 111, 116, 130, 482/133, 134, 135, 136, 140, 142, 148
See application file for complete search history.

(56) References Cited

U.S. PATENT DOCUMENTS

| | | | |
|---|---|---|---|
| 248,121 | A | 10/1881 | Tuttle |
| 2,145,940 | A | 2/1939 | Marlowe |
| 2,252,156 | A | 8/1941 | Bell |
| 3,116,062 | A | 12/1963 | Zinkin |
| 3,446,503 | A | 5/1969 | Lawton |
| 3,592,465 | A | 7/1971 | Fulkerson, Jr. |
| 3,640,528 | A | 2/1972 | Proctor |
| 3,707,285 | A | 12/1972 | Martin |
| 3,917,262 | A | 11/1975 | Salkeld |
| 4,004,801 | A | 1/1977 | Campanero et al. |
| 4,111,414 | A | 9/1978 | Roberts |

(Continued)

FOREIGN PATENT DOCUMENTS

| | | |
|---|---|---|
| CA | 2075331 | 2/1994 |
| GB | 2162075 | 1/1986 |
| SU | 1674874 | 9/1991 |

OTHER PUBLICATIONS

Gym 80 08006 Back Machine, (date unknown), is admitted prior art for this application, 2 pages.

(Continued)

*Primary Examiner* — Loan H Thanh
*Assistant Examiner* — Shila Jalalzadeh Abyan
(74) *Attorney, Agent, or Firm* — Procopio Cory Hargreaves & Savitch LLP

(57) ABSTRACT

A low back exercise machine has a pivotally mounted user support frame carrying a user seat and a foot rest assembly, an exercise arm carrying a back pad pivotally mounted relative to the user support frame, and a connecting linkage which translates movement of the exercise arm into rotation of the user support frame about its pivot axis, whereby the user support including the foot rests moves from an upright into a rearwardly reclined orientation as the user pushes the back pad rearward and downward to lean backwards so as to exercise the lower back muscles.

25 Claims, 7 Drawing Sheets

(56) References Cited

U.S. PATENT DOCUMENTS 4,149,714 A 4/1979 Lambert, Jr.
4,231,568 A 11/1980 Riley et al.
4,300,760 A 11/1981 Bobroff
4,336,934 A 6/1982 Hanagan et al.
4,387,893 A * 6/1983 Baldwin ..... 482/137
4,390,179 A 6/1983 Szkalak
4,441,708 A 4/1984 Brentham
4,448,412 A 5/1984 Brentham
4,468,025 A 8/1984 Sferle
4,478,411 A 10/1984 Baldwin
4,500,089 A 2/1985 Jones
4,511,137 A 4/1985 Jones
4,577,861 A 3/1986 Bangerter et al.
4,598,907 A 7/1986 Ross
4,632,390 A 12/1986 Richey
4,641,833 A 2/1987 Trethewey
4,666,152 A 5/1987 Jones
4,678,185 A 7/1987 Mahnke
4,684,126 A 8/1987 Dalebout et al.
4,700,946 A 10/1987 Breunig
4,743,010 A 5/1988 Geraci
4,790,530 A 12/1988 Maag
4,793,608 A 12/1988 Mahnke et al.
4,822,038 A 4/1989 Maag
D301,597 S 6/1989 Lehtonen
4,844,456 A 7/1989 Habing et al.
4,858,915 A 8/1989 Szabo
D303,558 S 9/1989 Alessandri
4,911,438 A 3/1990 Van Straaten
4,915,377 A 4/1990 Mahnke et al.
4,917,379 A 4/1990 Maag
4,943,051 A 7/1990 Haskins et al.
4,944,641 A 7/1990 Habing
4,949,951 A 8/1990 Deola
4,949,958 A 8/1990 Richey
5,011,139 A 4/1991 Towley
5,050,873 A 9/1991 Jones
5,056,779 A * 10/1991 Webb ..... 482/137
5,066,003 A 11/1991 Jones
5,066,004 A 11/1991 Jones
5,100,128 A 3/1992 Mabry
5,106,081 A 4/1992 Webb
5,108,095 A 4/1992 Nichols
5,217,422 A 6/1993 Domzalski
5,221,245 A 6/1993 Yeh
5,236,406 A 8/1993 Webber
5,250,013 A 10/1993 Brangi
5,254,067 A 10/1993 Habing et al.
5,263,914 A 11/1993 Simonson et al.
5,267,930 A 12/1993 Henes
5,299,997 A 4/1994 Chen
5,304,107 A 4/1994 Eckmann
5,322,489 A 6/1994 Webb et al.
5,330,404 A 7/1994 Lopeteguy et al.
5,330,405 A 7/1994 Habing et al.
5,334,120 A 8/1994 Rasmussen
5,342,269 A 8/1994 Huang et al.
5,342,270 A 8/1994 Jones
5,346,447 A 9/1994 Stearns
5,352,171 A 10/1994 Lin
5,354,248 A 10/1994 Rawls et al.
5,356,357 A 10/1994 Wang et al.
5,356,358 A 10/1994 Chen
5,366,432 A 11/1994 Habing et al.
5,387,171 A 2/1995 Casey et al.
5,401,227 A 3/1995 Webber
D357,041 S 4/1995 McBride et al.
5,409,440 A 4/1995 Yang
5,417,633 A 5/1995 Habing
5,417,634 A 5/1995 Habing
5,419,751 A 5/1995 Byrd et al.
5,421,796 A 6/1995 Jones et al.
5,437,589 A 8/1995 Habing
5,447,480 A 9/1995 Fulks
5,449,959 A 9/1995 Holmes
5,453,066 A 9/1995 Richter, Jr.
5,458,553 A 10/1995 Wu
5,478,298 A 12/1995 Chen
5,484,365 A 1/1996 Jones et al.
5,486,150 A 1/1996 Randolph
5,498,222 A 3/1996 Hur
5,499,959 A 3/1996 Holmes et al.
5,503,608 A 4/1996 Chang
5,505,679 A 4/1996 McBride et al.
5,507,710 A 4/1996 Chen
5,518,477 A 5/1996 Simonson
5,520,599 A 5/1996 Chen
5,527,243 A 6/1996 Chen
5,527,249 A 6/1996 Harris
5,527,250 A 6/1996 Chen
5,533,953 A 7/1996 Lui et al.
5,540,639 A 7/1996 Potts et al.
D372,509 S 8/1996 Yang
5,547,443 A 8/1996 Chen
5,547,444 A 8/1996 Huang et al.
5,549,530 A 8/1996 Fulks
5,549,533 A 8/1996 Olson et al.
5,554,086 A 9/1996 Habing et al.
5,562,577 A 10/1996 Nichols et al.
5,573,482 A 11/1996 Wang et al.
5,580,340 A 12/1996 Yu
5,580,341 A 12/1996 Simonson
5,582,563 A 12/1996 Fan
5,597,375 A 1/1997 Simonson
5,603,678 A 2/1997 Wilson
5,616,105 A 4/1997 Wang
5,616,107 A 4/1997 Simonson
5,620,402 A 4/1997 Simonson
5,626,542 A 5/1997 Dalebout et al.
5,628,715 A 5/1997 Simonson
5,643,147 A 7/1997 Huang
5,643,152 A 7/1997 Simonson
5,658,227 A 8/1997 Stearns
D383,814 S 9/1997 Ward
D384,118 S 9/1997 Deblauw
5,669,865 A * 9/1997 Gordon ..... 482/142
5,672,142 A 9/1997 Wu
5,674,161 A 10/1997 Lin
5,676,626 A 10/1997 Huang
5,681,247 A 10/1997 Webber
5,683,334 A 11/1997 Webber
5,690,593 A 11/1997 Huang
5,695,434 A 12/1997 Dalebout et al.
5,695,435 A 12/1997 Dalebout et al.
5,702,328 A 12/1997 Mansvelt
5,711,749 A 1/1998 Miller
5,720,695 A 2/1998 Eckmann
5,722,918 A 3/1998 Lee
5,733,229 A 3/1998 Dalebout et al.
5,733,232 A 3/1998 Hsu
5,733,233 A * 3/1998 Webber ..... 482/137
5,749,813 A 5/1998 Domzalski
5,800,321 A 9/1998 Webber
5,803,882 A 9/1998 Habing et al.
5,810,698 A 9/1998 Hullett et al.
5,810,701 A 9/1998 Ellis et al.
5,827,158 A 10/1998 Drecksel
5,876,095 A 3/1999 Johnston
5,885,193 A 3/1999 Habing et al.
5,897,467 A 4/1999 Habing et al.
5,897,473 A 4/1999 Koenig
5,899,836 A 5/1999 Chen
5,906,564 A 5/1999 Jacobsen
5,916,072 A 6/1999 Webber
5,938,570 A 8/1999 Maresh
5,938,571 A 8/1999 Stevens
5,944,641 A 8/1999 Habing
5,961,427 A 10/1999 Habing et al.
5,961,428 A 10/1999 Webber
5,967,954 A 10/1999 Habing
5,971,895 A 10/1999 Habing
5,971,901 A 10/1999 Shaw
5,989,165 A 11/1999 Giannelli et al.
5,997,446 A 12/1999 Stearns

(56) References Cited

U.S. PATENT DOCUMENTS

| | | | | |
|---|---|---|---|---|
| 5,997,447 | A | 12/1999 | Giannelli et al. | |
| 6,004,247 | A | 12/1999 | Webber | |
| 6,024,677 | A | 2/2000 | Siwertz | |
| 6,030,322 | A | 2/2000 | Webber | |
| 6,056,675 | A | 5/2000 | Aruin et al. | |
| 6,056,678 | A | 5/2000 | Giannelli | |
| 6,071,216 | A | 6/2000 | Giannelli et al. | |
| 6,074,328 | A | 6/2000 | Johnson | |
| 6,080,091 | A | 6/2000 | Habing et al. | |
| 6,086,521 | A | 7/2000 | Solland | |
| 6,090,020 | A | 7/2000 | Webber | |
| 6,120,419 | A | 9/2000 | Huang | |
| 6,135,930 | A | 10/2000 | Kuo | |
| 6,142,914 | A | 11/2000 | Crawford et al. | |
| 6,142,917 | A | 11/2000 | Giannelli et al. | |
| 6,152,864 | A | 11/2000 | Giannelli et al. | |
| 6,162,153 | A | 12/2000 | Perez et al. | |
| 6,168,557 | B1 * | 1/2001 | Liao | 482/140 |
| 6,220,993 | B1 | 4/2001 | Sencil | |
| 6,244,995 | B1 | 6/2001 | Prsala | |
| 6,244,996 | B1 | 6/2001 | Sencil | |
| 6,251,047 | B1 | 6/2001 | Stearns et al. | |
| 6,254,516 | B1 | 7/2001 | Giannelli et al. | |
| 6,264,588 | B1 | 7/2001 | Ellis | |
| 6,287,241 | B1 | 9/2001 | Ellis | |
| 6,302,832 | B1 | 10/2001 | Stearns | |
| 6,302,833 | B1 | 10/2001 | Ellis et al. | |
| 6,312,366 | B1 | 11/2001 | Prusick | |
| 6,319,178 | B1 | 11/2001 | Webber | |
| 6,340,342 | B1 | 1/2002 | Lee | |
| 6,350,219 | B1 | 2/2002 | Hobson | |
| 6,387,020 | B1 | 5/2002 | Simonson | |
| 6,394,937 | B1 | 5/2002 | Voris | |
| 6,491,609 | B2 | 12/2002 | Webber | |
| 6,517,468 | B1 | 2/2003 | Lapcevic | |
| 6,561,960 | B2 | 5/2003 | Webber | |
| 6,579,213 | B1 | 6/2003 | Webber et al. | |
| 6,605,022 | B2 | 8/2003 | Webber | |
| 6,605,024 | B2 * | 8/2003 | Stearns | 482/142 |
| D481,428 | S | 10/2003 | Giannelli et al. | |
| 6,659,919 | B2 | 12/2003 | Deola | |
| 6,676,577 | B2 | 1/2004 | Stearns | |
| 6,743,158 | B2 | 6/2004 | Giannelli et al. | |
| 6,752,748 | B1 | 6/2004 | Scotti | |
| 6,770,017 | B1 | 8/2004 | Leipheimer | |
| 6,811,522 | B1 | 11/2004 | McQuinn | |
| 6,855,098 | B2 | 2/2005 | Reitz et al. | |
| 6,913,565 | B2 | 7/2005 | Mitchell et al. | |
| 6,916,278 | B2 | 7/2005 | Webber | |
| 6,966,872 | B2 | 11/2005 | Eschenbach | |
| 6,971,978 | B2 | 12/2005 | Hyder | |
| 6,988,977 | B2 | 1/2006 | Webber et al. | |
| 7,052,444 | B2 | 5/2006 | Webber | |
| 7,052,446 | B2 | 5/2006 | Morris et al. | |
| 7,070,545 | B2 | 7/2006 | Lull et al. | |
| 7,108,641 | B2 | 9/2006 | Pertegaz-Esteban | |
| 7,115,081 | B2 * | 10/2006 | Stearns | 482/140 |
| 7,141,003 | B2 | 11/2006 | Wu | |
| 7,141,008 | B2 | 11/2006 | Krull et al. | |
| 7,166,066 | B2 | 1/2007 | Webber | |
| 7,220,221 | B2 | 5/2007 | Mosimann et al. | |
| 7,223,213 | B2 | 5/2007 | Golesh | |
| 7,229,389 | B2 | 6/2007 | Hong | |
| 7,322,906 | B2 | 1/2008 | Webber | |
| 7,331,911 | B2 | 2/2008 | Webber et al. | |
| 7,335,140 | B2 | 2/2008 | Webber et al. | |
| 7,357,761 | B2 | 4/2008 | Mattox | |
| 7,357,768 | B2 | 4/2008 | Marshall | |
| 7,361,125 | B2 | 4/2008 | Webber et al. | |
| 7,377,887 | B1 * | 5/2008 | Rosenow et al. | 482/134 |
| 7,384,381 | B2 | 6/2008 | Webber et al. | |
| 7,468,024 | B2 | 12/2008 | Webber et al. | |
| 7,549,949 | B2 | 6/2009 | Webber et al. | |
| 7,553,263 | B2 | 6/2009 | Webb et al. | |
| 7,563,209 | B2 | 7/2009 | Webber et al. | |
| 7,594,880 | B2 | 9/2009 | Webber et al. | |
| 7,601,187 | B2 | 10/2009 | Webber et al. | |
| 7,654,938 | B2 | 2/2010 | Webber et al. | |
| 7,654,940 | B2 | 2/2010 | Webber et al. | |
| 7,670,269 | B2 | 3/2010 | Webber et al. | |
| 7,717,832 | B2 | 5/2010 | Webber et al. | |
| 7,731,638 | B2 | 6/2010 | Webber et al. | |
| 7,766,802 | B2 | 8/2010 | Webber et al. | |
| 7,794,371 | B2 | 9/2010 | Webber et al. | |
| 7,794,372 | B1 | 9/2010 | Webber et al. | |
| 7,794,376 | B2 * | 9/2010 | Chou | 482/140 |
| 7,878,953 | B2 | 2/2011 | Webber et al. | |
| 7,938,760 | B1 | 5/2011 | Webber et al. | |
| 7,981,010 | B1 | 7/2011 | Webber et al. | |
| 7,993,251 | B1 | 8/2011 | Webber et al. | |
| 2002/0013199 | A1 | 1/2002 | Giannelli et al. | |
| 2002/0103058 | A1 | 8/2002 | Webber | |
| 2002/0183173 | A1 | 12/2002 | Abelbeck et al. | |
| 2002/0187879 | A1 | 12/2002 | Ball et al. | |
| 2003/0199362 | A1 | 10/2003 | Chamberlin | |
| 2004/0005966 | A1 | 1/2004 | Chen | |
| 2005/0032611 | A1 | 2/2005 | Webber et al. | |
| 2005/0096196 | A1 | 5/2005 | Webber et al. | |
| 2005/0096197 | A1 | 5/2005 | Webber et al. | |
| 2005/0096198 | A1 * | 5/2005 | Webber et al. | 482/97 |
| 2006/0116253 | A1 | 6/2006 | Nizam | |
| 2006/0148625 | A1 | 7/2006 | Garner | |
| 2006/0211549 | A1 | 9/2006 | Nohejl | |
| 2006/0247107 | A1 | 11/2006 | Carter | |
| 2006/0276313 | A1 | 12/2006 | Hong | |
| 2007/0037673 | A1 | 2/2007 | Giannelli et al. | |
| 2007/0232462 | A1 | 10/2007 | Webber et al. | |
| 2007/0232467 | A1 | 10/2007 | Puzey | |
| 2007/0270290 | A1 | 11/2007 | Mosimann et al. | |
| 2007/0293377 | A1 | 12/2007 | Webber et al. | |
| 2007/0293378 | A1 | 12/2007 | Webber et al. | |
| 2008/0058176 | A1 * | 3/2008 | Webber et al. | 482/94 |
| 2008/0058181 | A1 * | 3/2008 | Webber et al. | 482/136 |
| 2008/0064577 | A1 * | 3/2008 | Pederson et al. | 482/140 |
| 2008/0085822 | A1 * | 4/2008 | Webb et al. | 482/140 |
| 2008/0132389 | A1 | 6/2008 | Webber et al. | |
| 2008/0153677 | A1 * | 6/2008 | Webber et al. | 482/96 |
| 2008/0182732 | A1 | 7/2008 | Webber et al. | |
| 2008/0214365 | A1 | 9/2008 | Webber et al. | |
| 2008/0214367 | A1 | 9/2008 | Webber et al. | |
| 2008/0220950 | A1 | 9/2008 | Webber et al. | |
| 2008/0234110 | A1 | 9/2008 | Webber et al. | |
| 2008/0242517 | A1 | 10/2008 | Webber et al. | |
| 2008/0248929 | A1 | 10/2008 | Webber et al. | |

OTHER PUBLICATIONS

Tuff Stuff KDX-2 Gym, (date unknown), is admitted prior art for this application, 1 page.
Flex FB-306 Low Back Machine, (date unknown), is admitted prior art for this application, 1 page.
Cybex Back Extension, 1990, 1 page.
Paramount AP-3300 Lower Back, 2001, 1 page.
Body Masters CX210 Back Extension, (date unknown), is admitted prior art for this application, 1 page.
Hoist HS 1225 Low Back, 2006, 1 page.
Hoist Dual 600 Abdominals and Lower Back 1998, 1 page.
Body Masters brochure, 2002, 1 page.
CD 2400 Leg Extension/Leg Curl, Hoist Fitness Systems, Owner's Catalog, 2005, 1 page.
Flex Fitness Brochure, (date unknown), is admitted prior art for this application, 1 page.
Flex Product Sheet, (date unknown), is admitted prior art for this application, 1 page.
Hoist brochure, 1993 Hoist HLP brochure, 1998, 1 page.
Low Back Machine, Hoist Brochure, HS1225, 2005, 1 page.
Models 217 and 206-2, Polaris Brochure, (date unknown), is admitted prior art for this application, 1 page.

* cited by examiner

LOW BACK EXERCISE MACHINE WITH ROCKING USER SUPPORT

RELATED APPLICATION

The present application claims the benefit of U.S. provisional patent application No. 61/310,585 filed Mar. 4, 2010, which is incorporated herein by reference in its entirety.

BACKGROUND

1. Field of the Invention

This invention relates generally to exercise machines, and is particularly concerned with a low back exercise machine.

2. Related Art

The lower back muscles may be exercised by lying face down on the floor and then lifting the chest from the ground, or by bending down from the waist and then reversing back into an upright position. Lower back muscles can also be exercised using low back exercise machines, which typically have a seat with a rotatably mounted back rest linked to an exercise resistance. The seated user pushes back against the back rest to move it from an upright or forwardly inclined position back into a rearwardly reclined position. In most low back machines, the seat and a foot plate for engagement by the user are stationary during the exercise. This can cause the user to pop up from the seat as they push the back rest and move into a rearwardly reclined position. In some machines, such as the Hoist HS 1225, the seat is linked to the exercise arm so that it tilts rearward slightly to help keep the user from popping out of the seat, but the foot rest is stationary during the exercise. Some machines for exercising the lower back are dual function, combining abdominal and lower back exercises, or low back and leg press exercises.

SUMMARY

A low back exercise machine in one embodiment has a pivotally mounted user support frame carrying a user seat and an adjustable foot rest assembly, an exercise arm carrying a back pad pivotally mounted relative to the user support frame for engagement by a user's back when seated on the user seat, and a connecting linkage which translates movement of the exercise arm into rotation of the user support frame about its pivot axis. An exercise resistance is linked to the exercise arm in one embodiment. In alternative embodiments, the exercise resistance may be linked to resist movement of the user support or connecting link.

In order to perform the lower back exercise, a user sits on the user support seat with their feet engaging the foot rest, then leans backwards to push against the back pad, rotating the exercise arm rearward about its pivot axis. This in turn rotates the user support frame about its pivot axis via the connecting linkage, so that both the user seat and the foot rest move together as the exercise arm is rotated.

The combined movement of the user support and exercise arms provides a more comfortable and natural feeling exercise motion that constantly adjusts the position of the user during the exercise to reduce stress on muscles in the low back and groin. The rocking motion of the user support during the exercise also makes the exercise more enjoyable for the exerciser. Since the user's feet track the user support seat as the exercise is performed, there is less risk of the user popping up out of the seat during the exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
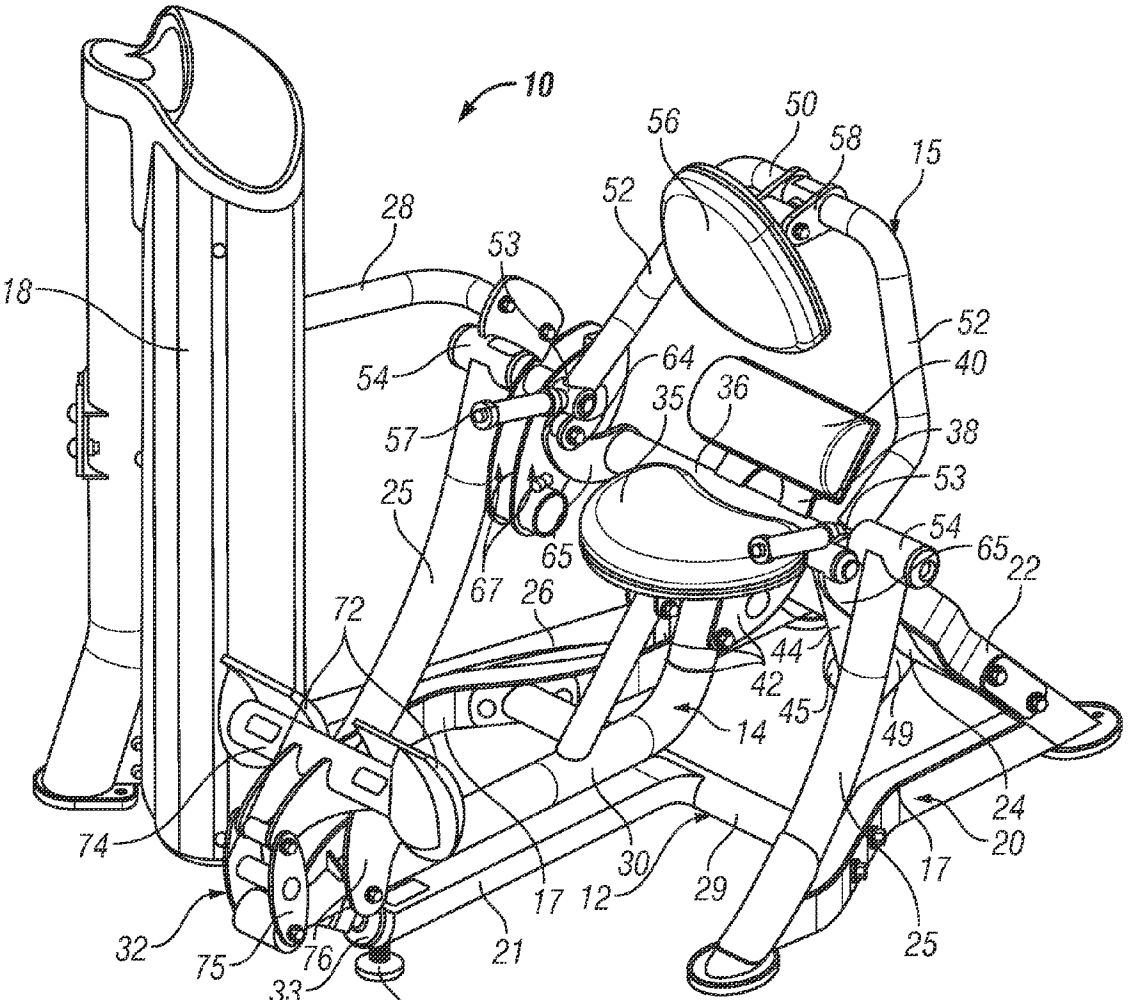
FIG. 1 is a front perspective view of a low back exercise machine according to a first embodiment, with the machine in a start position for a lower back exercise.

Certain embodiments as disclosed herein provide for a low back exercise machine with a rocking user support. Both the user support and the exercise arm move during an exercise, with a connecting linkage translating movement of the exercise arm to rocking movement of the user support so that the user support moves in a predetermined path as the exercise arm rotates rearward during the exercise. In one embodiment, the user support moves forward and upward while the rear end of the user support tilts downward as the exercise arm is rotated rearward by the user.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 7 illustrate one embodiment of a low back exercise machine 10 for exercising the muscles of the lower back. Machine 10 has a stationary, floor engaging main frame 12, a pivotally mounted user support frame 14, and an exercise arm or user engagement device 15 which is pivotally mounted on the main frame. A conventional weight stack 16 in housing 18 is linked to the exercise arm via a cable and pulley assembly 19 (see FIG. 2). The weight stack and associated connecting struts are omitted in FIGS. 3, 4 and 5 for clarity.

Figure 7:
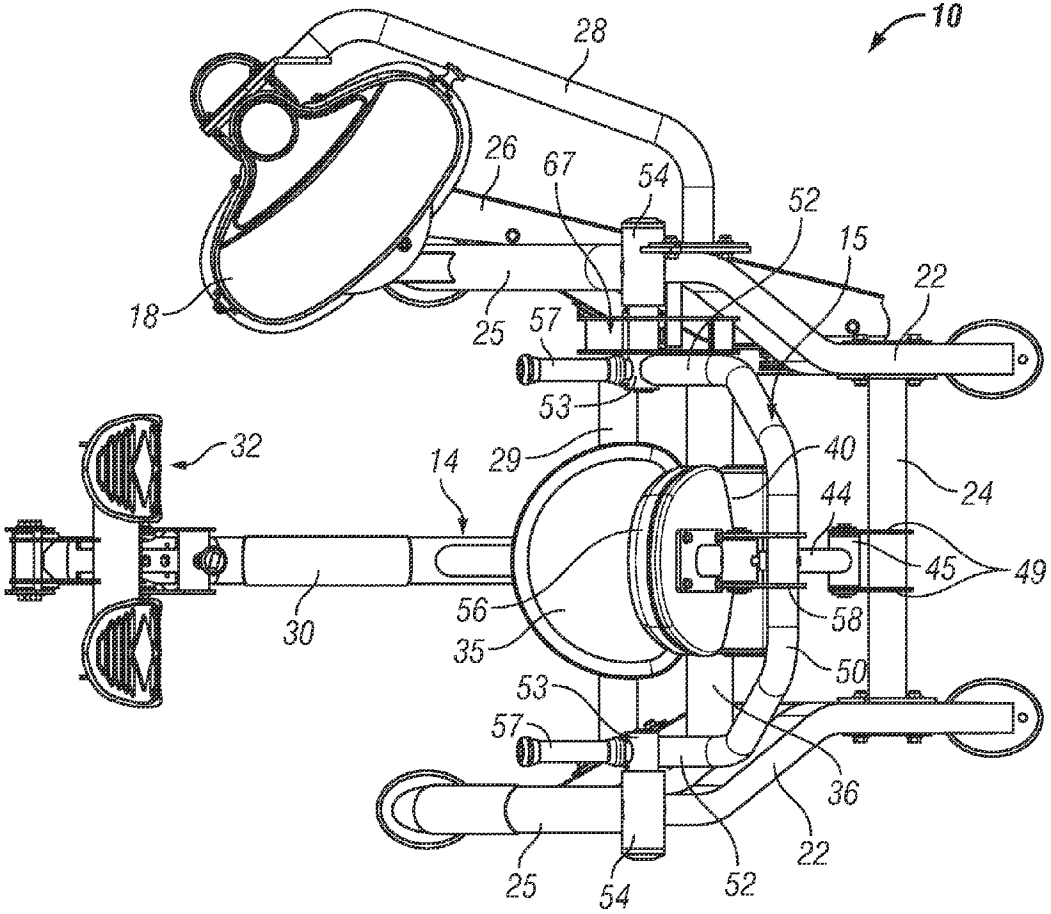
FIG. 7 is a top plan view of the machine of FIGS. 1 to 6.

The main frame has a base portion 20, forwardly inclined rear uprights 22 connected by cross bar or strut 24, and spaced rearwardly inclined front uprights 25 which are connected to the rear uprights 22. Base portion 20 has a pair of side struts 17 extending between the lower ends of uprights 22 and 25, a cross bar 29 extending between the side struts, and a generally central strut 21 extending forwards from cross bar 29. Strut 21 has an inclined end stop face 23 and is supported by an adjustable stabilizing foot 27 at its forward end. As best illustrated in FIG. 7, the weight stack housing is connected to one of the front uprights 25, and is also connected to the main frame base via cable guide tube 26 and to one of the rear uprights 22 via connecting arm 28.

User support frame 14 has a base support strut 30 with a foot rest assembly 32 adjustably mounted at or adjacent its forward end and an upwardly inclined rear portion secured to a mounting plate 34 on which user seat pad 35 is mounted. A bumper stop 33 extends downward at an angle from base support strut 30 below the foot rest assembly, and engages the end stop face 23 at the forward end of the main frame when the user support is in the start position of FIGS. 1 to 3. Frame 14 also includes a cross bar or strut 36 extending across the back of seat pad 35, and a lumbar pad support plate 38 which extends upwards and rearwards from cross strut 36, as illustrated in FIG. 2. Lumber pad 40 is mounted on support plate 38. Connecting brackets 42 are secured to cross strut 36 and connected to both support strut 30 (see FIG. 1) and support plate 38 (see FIG. 2). A control link 44 is pivotally connected between brackets 42 and the base portion of the main frame. Link 44 is pivoted to the cross strut 24 of the main frame base at its lower end via pivot sleeve 45 rotatably secured between brackets 49 which extend from strut 24, and rotates about pivot axis 46, and is pivoted to the user support brackets 42 at its upper end via a similar pivot sleeve 47 for rotation about pivot axis 48, as best illustrated in FIGS. 2, 3 and 7.

The exercise arm 15 comprises a generally U-shaped yoke having a central portion 50 and opposite arm portions 52 extending downwardly from central portion 50. Pivot sleeves 53 at the lower ends of the respective arm portions are pivotally connected to pivot mounts 54 at the upper ends of main frame struts 25 for rotation about exercise arm pivot axis 55. A stabilizing handle or grip 57 is secured to each pivot sleeve 53. Back pad 56 is pivotally connected to the central portion 50 of the exercise arm via pivot brackets 58 for rotation about pivot axis 60 so that it adjusts and aligns to the user's back orientation during an exercise.

As best illustrated in FIGS. 1, 2, 4 and 6, connecting links or brackets 64 are secured to respective exercise arm pivot sleeves 53. End plates 65 at opposite ends of user support cross strut 36 are pivotally connected to the respective connecting links 64 for rotation about user support pivot axis 66. One of the pivot sleeves on the side of the machine closest to the weight stack is also connected to a resistance cam 67 of cable and pulley assembly 19, and weight bearing cable 69 extends from the weight stack through guide tube 26 and around pulleys 70, 71, and from pulley 71 to resistance cam 67. The arrangement is such that the cable is pulled as the exercise arm rotates from the start position of FIGS. 1 to 3 into an end position as in FIG. 4.

The foot rest assembly 32 comprises a pair of foot rests 72 mounted on the ends of cross bar 74 which is pivotally mounted on a forward end portion of user support strut 30 via pivot links 75, 76. A range of motion adjustment plate 78 (FIG. 3) secured to one side of strut 30 has a series of holes engaged by pull pin adjuster 80 to secure the foot rests in a desired position.

Figure 2:
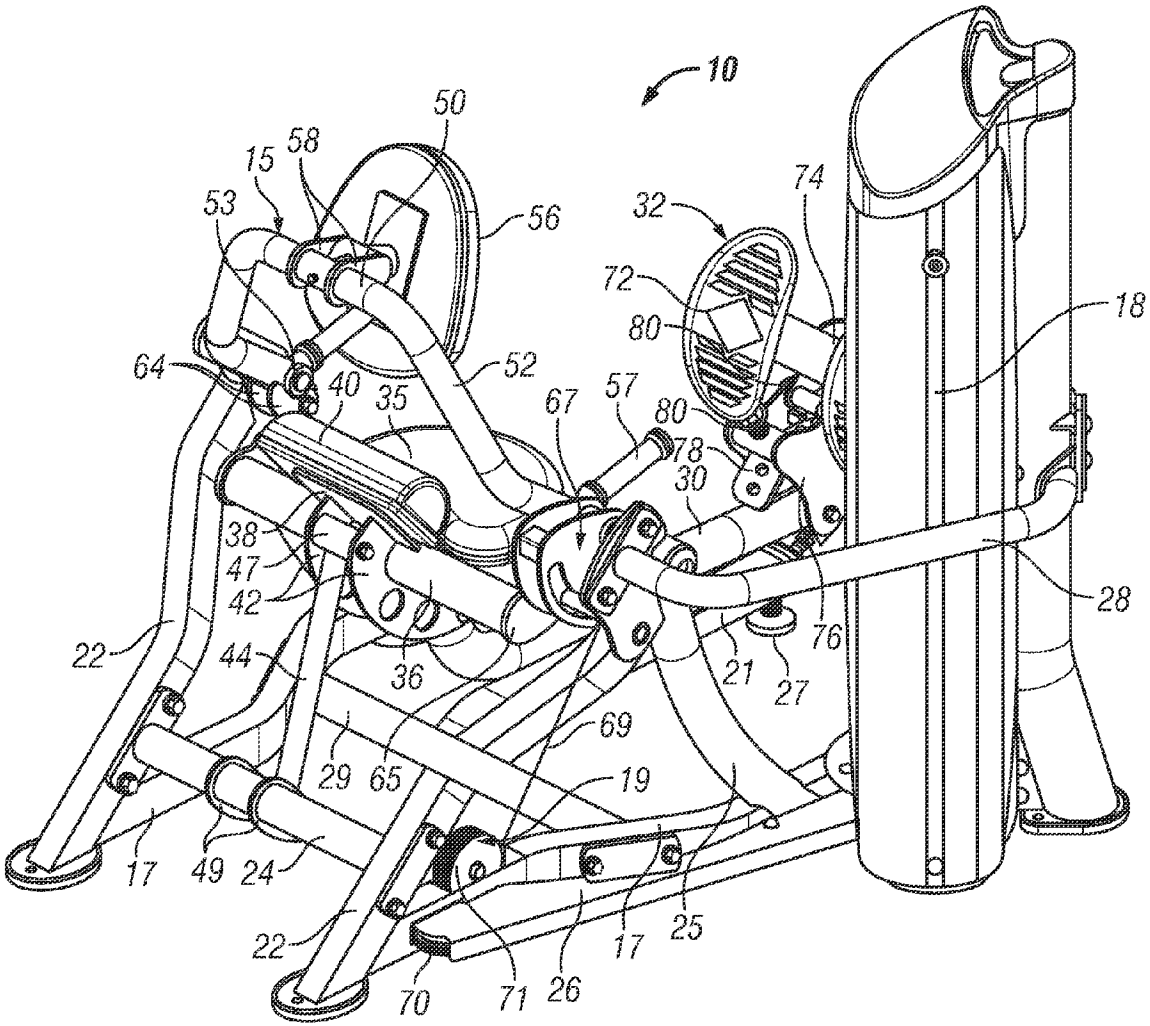
FIG. 2 is a rear perspective view of the machine of FIG. 1.
Figure 3:
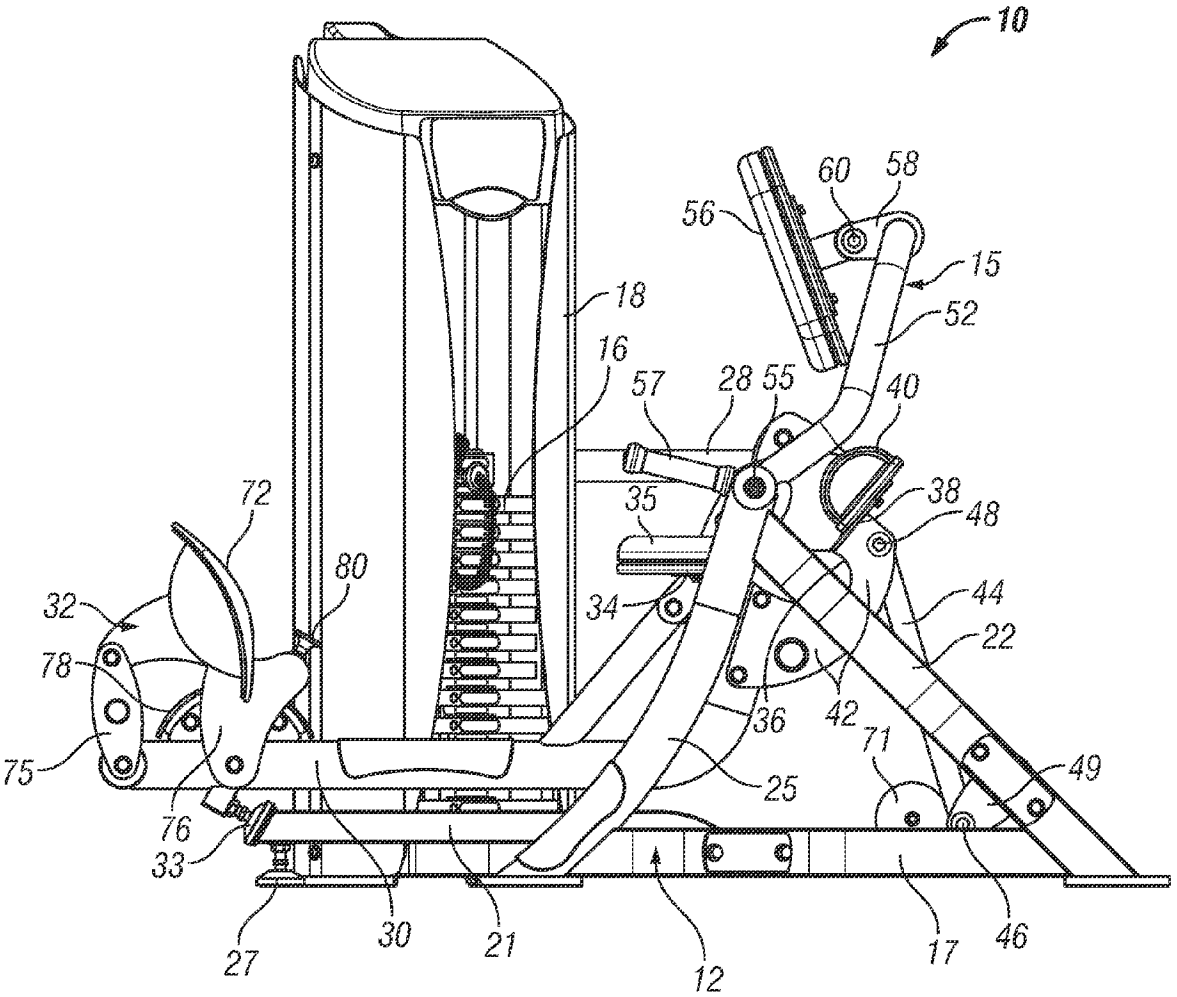
FIG. 3 is a side elevation view of the machine in the start position of FIGS. 1 and 2.

In order to perform a lower back exercise, a user sits on the user support with the moving parts in the start position of FIGS. 1 to 3, with their low back against lumber pad 40, and their upper back against the user engaging back pad. They then adjust the foot rest assembly to fit their leg length if needed. Next, the user grabs the stabilizing handles 57 for support and leans backwards, putting pressure against the back pad 56 and rotating the exercise arm 15 about pivot axis 55 against the exercise resistance linked to the exercise arm. The connecting links 64 between the exercise arm and user support force the user support to move upward, while the control link 44 between the rear of the user support and the stationary main frame 12 tilts the back end of the user support downward. The result is a compound forward and upward movement of the foot rest and a reclining movement of the seat. The user support seat, lumbar pad, and foot rest are all mounted on the user support frame and fixed at the same relative orientation to one another throughout the exercise, so that the user's feet track the user support during the exercise and the user is in a secure, stable position throughout the movement. This reduces or eliminates the tendency for the user to pop up out of the seat when pushing back into a reclined position.

Figure 4:
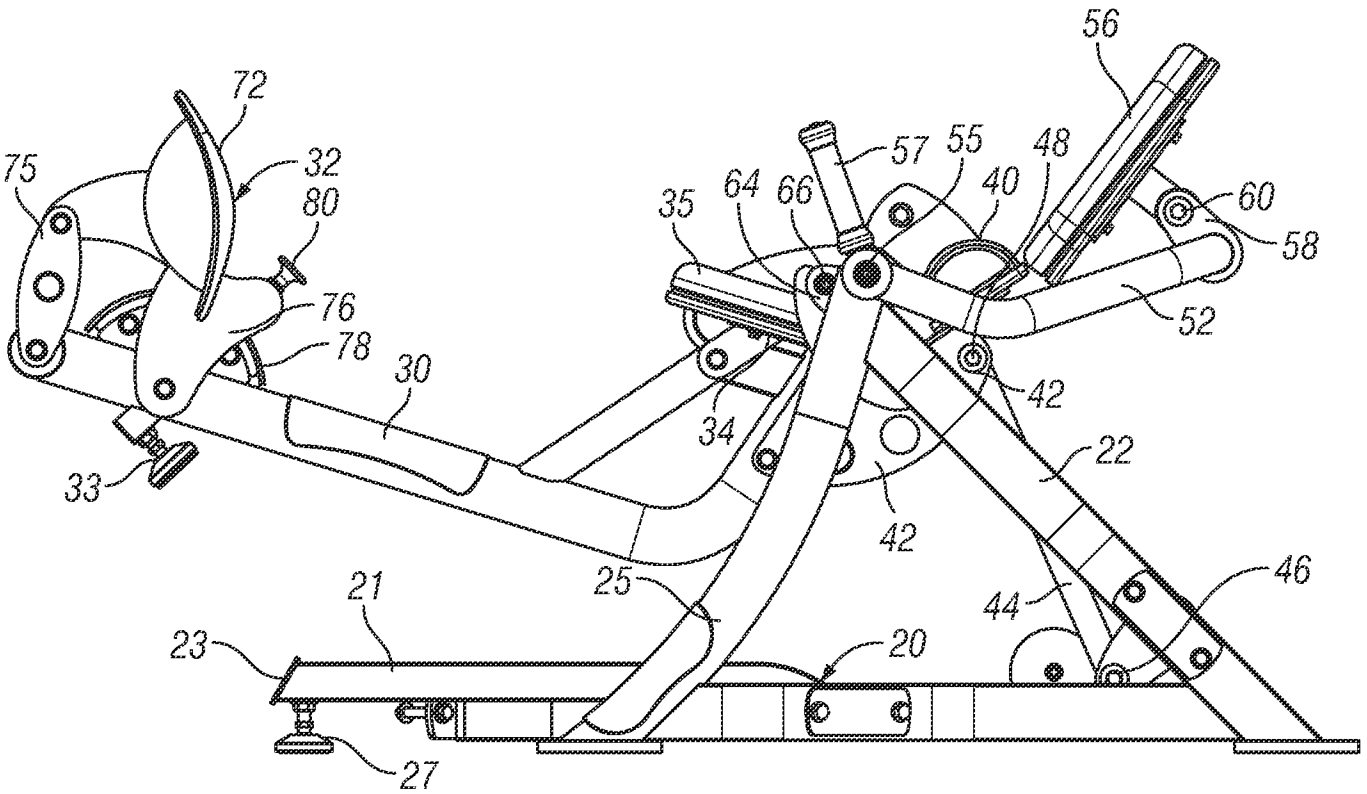
FIG. 4 is a side elevation view similar to FIG. 3 but showing an end position for the lower back exercise.
Figure 5:
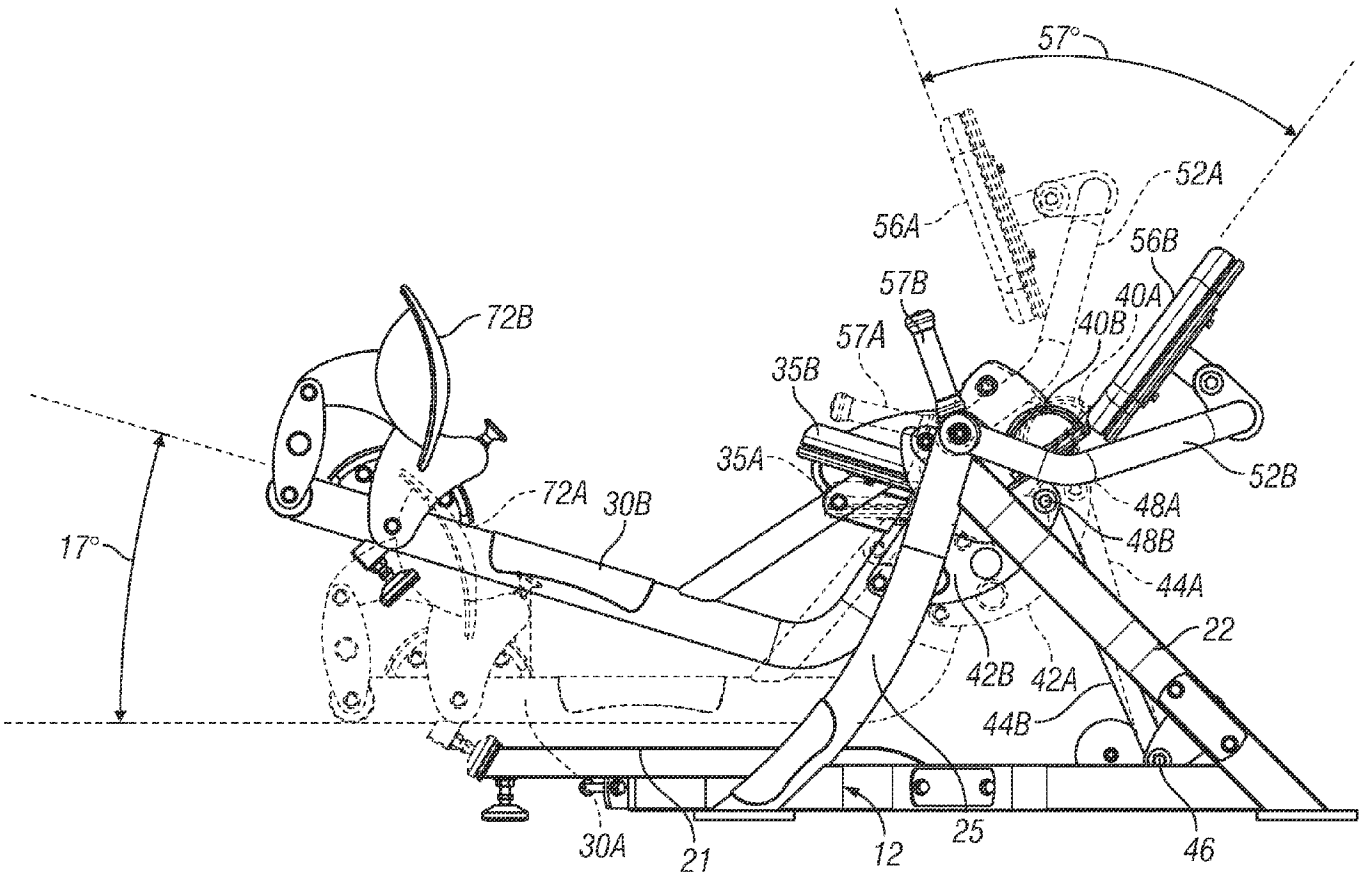
FIG. 5 is a side elevation view showing the two positions of FIGS. 3 and 4 superimposed, to illustrate movement of each moving part of the machine during an exercise.
Figure 6:
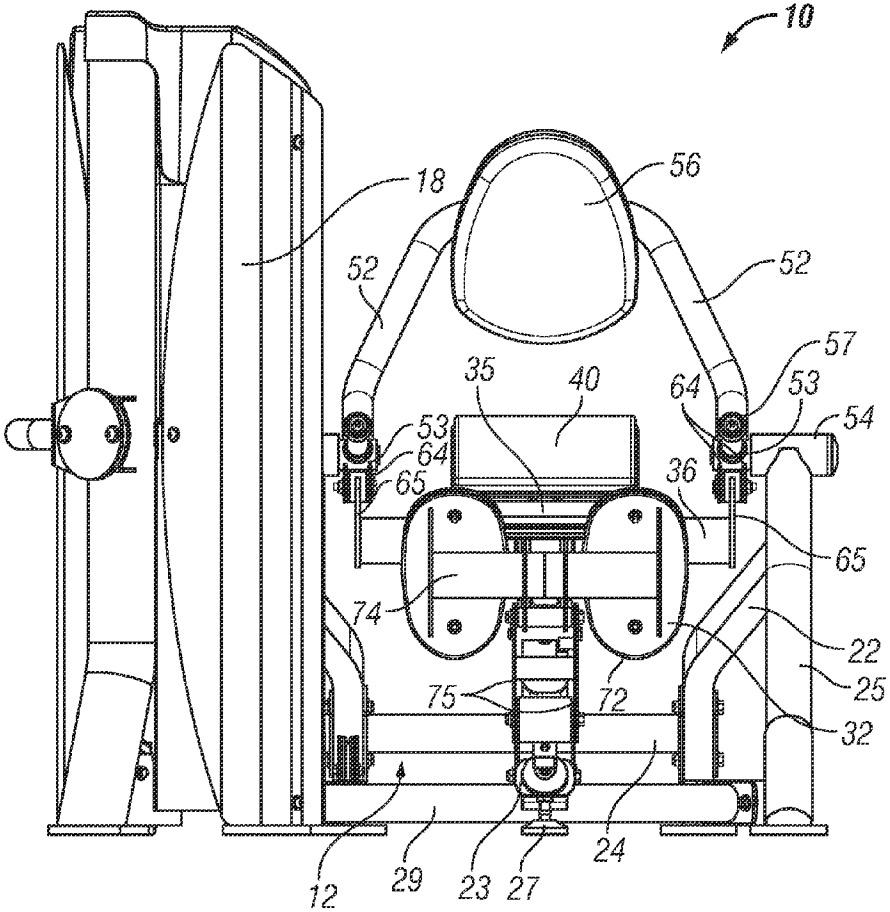
FIG. 6 is a front elevation view of the machine of FIGS. 1 to 5.

In FIG. 5, the start and finish positions of the machine in FIGS. 3 and 4 are overlapped. Part numbers followed by the letter A correspond to the dotted line, start position of the low back exercise machine and part numbers followed by the letter B correspond to the solid line, end position of the machine. As seen in FIG. 5, the user support starts in an upright condition with the user's legs extending approximately horizontally from the seat 35 to the foot rests 72, and the back pad inclined forwards so that the user is bent forward at the waist. As the user pushes the back rest from start position 56A into rearwardly inclined end position 56B, the user support seat 35B is rotated upward about pivot axis 66 while the user support frame is tilted downward at its rear end by the control link 44. This means that the foot rests 72 are raised up from position 72A to position 72B while the seat moves from position 35A to position 35B, and the user's legs remain in line with their body at substantially the same orientation relative to the torso throughout the exercise. The arrangement is such that the base strut of the user support frame tilts upward through an angle of around 17 degrees between the start position 30A and the end position 30B when the back rest is pushed rearward through an angle of around 57 degrees between the start position 56A and end position 56B. It should be understood that end position 56B is not a fixed, predetermined end position, but is controlled by the user based on how much they want to lean back in performing the exercise. The movement pattern between the exercise arm and the user support as controlled by the connecting link and control link reclines the user throughout the exercise so as to exercise the lower back muscles.

In the above embodiment, movement of the user engagement device or exercise arm is translated into rocking movement of a user support, making the exercise more enjoyable for the user. Additionally, the linked relationship between the movement of the exercise arm and the movement of the user support in the above embodiments is designed so that movement of the user support tracks movement of the exercise arms, with the user support seat moving into a slightly reclined position at the end of the exercise, and the foot rests tracking the movement of the seat. This provides a more comfortable, better feeling exercise that enhances the user's workout.

It should be understood that all the different elements used in the above embodiment may be mixed and interchanged with one another and still incorporate the essence of the above embodiment. The user support may be mounted on the main frame with the exercise arm pivotally mounted on the user support. The connecting links could be made adjustable and the solid links could be replaced by a cable. Cables could be replaced with belts, ropes, chains, or the like, and pulleys could be replaced with sprockets. The seat could be fixed or made adjustable relative to the supporting frame. Various different types of user engaging pads can be used.

The pivot mounts may have a single pivot or multiple pivots, and in the latter case the user support pivots about a theoretical pivot mount of the combined pivotal motion. Any of the various embodiments could have the resistance associated with any of the moving parts (user support, user engagement device, or connecting linkage). The exercise resistance may be a weight stack as in the above embodiments, or may be any other type of resistance known in the art, such as weight plates, elastic bands, or pneumatic, electromagnetic, or hydraulic resistance. The exercise machine may be a stand alone machine or may be part of a multi-station gym.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. A lower back exercise apparatus, comprising:

a stationary main frame having a forward end and a rear end;

a user support assembly movably mounted relative to the main frame and adapted to support a user in an exercise position, the user support assembly being movable in a predetermined user support path during a lower back exercise;

the user support assembly having primary support comprising a user support seat configured to support the user in a seated, exercise position, the user support seat having a forward end, and a secondary support comprising a foot rest spaced forward from the forward end of the user support seat and configured to support the user's feet with their legs extending forward and away from the user support seat towards the forward end of the main frame throughout the lower back exercise, the foot rest moving together with the user support seat and being in a fixed orientation relative to the user support seat throughout the lower back exercise movement;

an exercise arm assembly pivotally mounted relative to the main frame and having a user engaging portion which is adapted for engagement by a part of a user's body when the user is supported in an exercise position on the user support assembly, the user engaging portion comprising a back pad on the exercise arm configured for engagement with the upper back of the user during the lower back exercise;

a connecting linkage between the user support assembly and exercise arm assembly which links movement of the exercise arm assembly during the lower back exercise to movement of the user support assembly in said predetermined user support path; and a load which resists movement of at least one of the exercise arm assembly, the user support assembly, and the connecting linkage.

2. The apparatus of claim 1, the connecting linkage between the user support assembly and exercise arm assembly linking movement of the exercise arm assembly in a predetermined exercise path to movement of the user support assembly in said predetermined user support path;

wherein the exercise arm and back pad are configured to rotate rearward and downward in said predetermined exercise path during the lower back exercise in response to the user pushing backwards on said back pad.

3. The apparatus of claim 2, wherein the back pad is pivotally mounted on the exercise arm.

4. The apparatus of claim 2, wherein the exercise arm assembly further comprises handles configured for gripping by a user during a low back exercise.

5. The apparatus of claim 2, wherein the user support assembly comprises a user support frame having a rear portion and a forward portion, a user support seat on the rear end portion and a foot plate assembly on the forward portion, and the connecting linkage is configured to rotate said user support rearward and said foot plate assembly upward and forward when said back pad moves rearward and downward during the lower back exercise.

6. The apparatus of claim 1, wherein the user support assembly further comprises an additional support which is fixed relative to the user support seat and configured to support a position on a user's body spaced from the user support seat and foot rest when the user is seated on the user support seat.

7. The apparatus of claim 6, wherein the additional support comprises a lumbar pad at a rear of the user support seat and configured to support the lower back of the user during the lower back exercise.

8. The apparatus of claim 1, wherein the user support assembly has a user support frame having a rear portion and a forwardly extending portion fixed relative to said rear portion and extending forward from said rear portion to a forward end, the user support seat being located on the rear portion of said support frame, and the foot rest being mounted on the forwardly extending portion of said support frame at a location spaced forward from said user support seat, wherein the forward spacing between said user support seat and foot rest is fixed throughout movement of said user support assembly during the lower back exercise.

9. The apparatus of claim 8, wherein the foot rest is adjustably mounted on the forward portion of the user support frame to adjust the forward spacing between said user support seat and foot rest in order to accommodate users with different leg lengths, and an adjustable locking mechanism is associated with the foot rest and configured for releasably locking the foot rest in a selected adjusted position throughout the lower back exercise.

10. The apparatus of claim 1, wherein the exercise arm assembly comprises an exercise arm pivotally mounted relative to the main frame for rotation about an exercise arm pivot axis.

11. The apparatus of claim 10, wherein the user support assembly is pivotally mounted relative to the main frame for rotation about a user support pivot axis, and the back pad is pivotally mounted on the exercise arm for rotation about a back pad pivot axis spaced from said user support pivot axis.

12. The apparatus of claim 1, wherein said connecting linkage comprises a multi-part connecting linkage.

13. The apparatus of claim 12, wherein said connecting linkage comprises a control link pivotally connected between said user support assembly and said main frame and at least one pivot link between said exercise arm assembly and said user support assembly, whereby movement of said exercise arm assembly in an exercise path corresponding to a lower back exercise simultaneously moves said user support assembly in said predetermined user support path.

14. The apparatus of claim 1, wherein the user support assembly is pivotally mounted relative to the frame for rotation about a first pivot axis, and a vertical gravitational center line which extends through the first pivot axis extends through the user support assembly through at least part of the lower back exercise.

15. The apparatus of claim 14, wherein the vertical gravitational center line extends through the user support assembly throughout an entire lower back exercise.

16. The apparatus of claim 1, wherein the connecting linkage comprises at least one connecting link pivotally connected between the user support assembly and the main frame.

17. The apparatus of claim 16, wherein the connecting linkage further comprises a pivot link between the user support assembly and exercise arm assembly, the pivot link and connecting link being configured to move the user support assembly in a predetermined compound movement path during the lower back exercise.

18. The apparatus of claim 1, wherein the main frame has a pair of spaced, generally upright portions, the exercise arm assembly is pivotally connected between said upright portions for rotation about a first pivot axis, and the user support assembly is pivotally linked to the exercise arm assembly for rotation about a second pivot axis, the second pivot axis being spaced from the first pivot axis and parallel to the first pivot axis.

19. The apparatus of claim 18, wherein the user support assembly has a rear end portion and a forward end portion, and the connecting linkage comprises a connecting link pivotally connected to the user support assembly at a first location for rotation about a third pivot axis and pivotally connected to the main frame at a second location spaced below the first location for rotation about a fourth pivot axis, whereby rotation of said exercise arm assembly about said first pivot axis rotates the rear portion of said user support assembly rearward and the forward portion of said user support assembly upward.

20. The apparatus of claim 1, wherein the user support seat and back pad are configured to move in the same, rearward rotational direction from a starting orientation during a lower back exercise, and the back pad and user support are rearwardly reclined at the end of the lower back exercise.

21. The apparatus of claim 1, wherein the user support seat is configured for movement in a reclining movement path and said foot rest is configured for movement in a forward and upward movement when said user support assembly moves in said predetermined user support path during the lower back exercise, whereby the user's legs are supported at the same extended orientation relative to the user's body throughout the lower back exercise.

22. The apparatus of claim 1, wherein the exercise arm assembly is linked to the load.

23. The apparatus of claim 1, wherein the load comprises a selectorized weight stack.

24. A lower back exercise apparatus, comprising:

a stationary main frame having a forward end and a rear end;

a user support assembly pivotally mounted relative to the main frame for rotation about a user support pivot axis and adapted to support a user in a lower back exercise position, the user support assembly being movable in a predetermined user support path during a lower back exercise;

the user support assembly having primary support comprising a user support seat configured to support the user in a seated, exercise position and a secondary support configured to support a spaced position on the user's body throughout the lower back exercise, the secondary support moving together with the support seat throughout the lower back exercise, an exercise arm assembly comprising an exercise arm pivotally mounted relative to the main frame for rotation about an exercise arm pivot axis and a back pad pivotally mounted on the exercise arm which is adapted for engagement by the user's back when the user is supported in the lower back exercise position on the user support assembly;

a connecting linkage between the user support assembly and the exercise arm assembly which links movement of the exercise arm assembly during the lower back exercise to movement of the user support assembly in said predetermined user support path;

the connecting linkage being configured to move the user support seat in a reclining movement path when said exercise arm assembly is moved in the lower back exercise path;

the secondary support comprising a foot rest secured at a fixed position relative to the user support seat and configured to support the user's feet with their legs extended forward throughout the lower back exercise and configured to move in a forward and upward path when said user support seat moves in said reclining movement path; and a load which resists movement of at least one of the exercise arm assembly, the user support assembly, and the connecting linkage;

wherein the exercise arm assembly is pivotally mounted on the main frame for rotation about a first pivot axis and the user support assembly is pivotally linked to the exercise arm assembly.

25. The apparatus of claim 24, wherein the connecting linkage comprises a pivot link between the exercise arm assembly and the user support assembly and a control link pivotally connected between the user support assembly and the main frame.

* * * * *